US005471681A

United States Patent [19]

Ferrini

[11] Patent Number: 5,471,681

[45] Date of Patent: Dec. 5, 1995

[54] GLOVE HAVING A HOOK FOR STEADILY HOLDING A CONTAINER

[76] Inventor: Tom Ferrini, 2160 Fir Dr., Thornton, Colo. 80229

[21] Appl. No.: 189,430

[22] Filed: Jan. 31, 1994

[51] Int. Cl.[6] ..... A41D 19/00

[52] U.S. Cl. ..... 2/160; 2/161.6; D2/623

[58] Field of Search ..... 2/159, 160, 161.1, 2/161.5, 161.6, 162, 169; D2/610, 612, 614, 616, 617, 619, 621, 623; 220/752, 751, 755, 756

[56] References Cited

U.S. PATENT DOCUMENTS

| | | | |
|---|---|---|---|
| 20,008 | 12/1890 | Watson | 2/160 |
| D. 351,933 | 11/1994 | Stoneman | 2/160 X |
| 461,744 | 10/1891 | Fanshawe | 2/160 |
| 929,173 | 7/1909 | Stone . | |
| 1,463,977 | 8/1923 | Smith . | |
| 2,278,610 | 4/1942 | Brownson . | |
| 2,749,172 | 6/1956 | Jacobs . | |
| 3,417,840 | 12/1968 | Farnsworth . | |
| 3,541,990 | 11/1970 | Du Mas . | |
| 4,280,645 | 7/1981 | Goodden . | |
| 4,745,870 | 5/1988 | Roth . | |
| 5,092,481 | 3/1992 | Skelton . | |
| 5,110,154 | 5/1992 | Street . | |

*Primary Examiner*—C. D. Crowder
*Assistant Examiner*—Larry D. Worrell, Jr.
*Attorney, Agent, or Firm*—Sandeep Seth

[57] ABSTRACT

Method and apparatus for steadily holding a container with reduced stress to the thumb, hand, and wrist are disclosed. The container has a bottom, a side and a bale handle downwardly pivotable against the side. The apparatus includes engaging means, releasably engagable with the bale handle of the container when the bale handle is downwardly pivoted toward the container's side, for stabilizing the container relative to a palm of the hand when the container is held with the fingers of the same hand against the bottom of the container; and means for securing the engaging means about the palm of the hand in a fixed position generally adjacent to the palm of the hand. The securing means includes a first and a second surface which form a hand compartment, like a glove's, for a hand to slide within. The engaging means includes a base and an extension with a hook on its distal end for releasably engaging the bale handle. A wrist strap is also provided to adjust the hand compartment and support the user's wrist. The method of the present invention includes donning the glove about the hand and tightening it with provided support means. The method further includes supporting the container from its bottom with the fingers and engaging the engaging means to the bale handle. The container is thus steadily supported without needing the thumb of the hand.

15 Claims, 2 Drawing Sheets

GLOVE HAVING A HOOK FOR STEADILY HOLDING A CONTAINER

TECHNICAL FIELD

The invention generally relates to method and apparatus for holding containers and, more particularly, to method and apparatus for steadily holding with one hand a container having a bale handle.

BACKGROUND OF THE INVENTION

Recently, increased focus has been placed on the effects of cumulative stress disorders (CTD's) such as carpal tunnel syndrome, tendinitis, ganglionic cysts, etc. on productivity at the work place and worker pain and discomfort. Studies have shown that these disorders affect many types of workers such as computer operators, secretaries, certain machine workers, postal workers, and a host of other types of workers. A particular problem exists for painters who must hold paint containers, of the type having a bale handle, for long durations. These painters typically hold the paint container in one hand with the fingers of the same hand against the container's bottom to support the container and with the bale handle generally against the side of container so they may easily access the interior of the can with their paint brush. To stabilize the container, these painters generally hook their thumb over the bale handle. Holding the container as just described for long period, such as when a painter is "cutting in" (e.g., bordering the walls of a room,) or doing trim work, can result in accumulated stress to the heel area of the hand (i.e., around the base of the thumb), in the thumb, across the palm of the hand, across the transverse carpal ligament, or generally around the carpal tunnel area (ie., wrist). The accumulated loads and stresses to one or several of these areas can lead painters to experience chronic fatigue, soreness, or pain in these areas leading to CTD's including carpal tunnel syndrome.

A need, therefore, exists for an apparatus which could be used by a painter, or another, needing to steadily hold a container having a bale handle, which allows the person to steadily hold the container from its bottom with decreased stress to one or several of the aforementioned areas of the hand and wrist. It would be desirable, therefore, to have an apparatus which entirely eliminated the need for the user to use her thumb to stabilize the container. It would further be desirable if such an apparatus also gave support to the user's wrist to assist the user in holding the container from its bottom. Such an apparatus could provide further benefit by providing a convenient way to steadily hold the container in one hand which would eliminate the need to bend to dip the paint brush, allowing the painter, or other user, to do her work more rapidly and efficiently and with less accidental dripping. An added safety benefit would also be provided by such a apparatus, by allowing the painter to easily hold the container while standing on a ladder, or the like, thus allowing the painter to easily maintain balance on the ladder. Such an apparatus thus would also reduce or eliminate the need for the painter to rest the container on the ladder tray and thereby place herself in an off-balance position to access the container on the tray.

The inventor of the instant invention is aware of no device, apart from the instant invention, which addresses the aforementioned needs or provides the above stated benefits and advantages. Only one device, described in U.S. Pat. No. 5,092,481 to Skelton, is known by the inventor which is used to facilitate the user in stabilizing a container having a bale handle when such a container is held from its bottom. However, this device utilizes a loop attached to the bale handle for receiving the user's thumb. Thus, while suitable for its intended purpose, the device actually actively uses the user's thumb to stabilize the container and therefore neither eliminates nor reduces the stresses to the thumb or hand. Furthermore, the device does not provide any means for supporting the user's wrist to alleviate stresses thereto.

To achieve the foregoing and other objects and in accordance with the purpose of the present invention, as embodied and broadly described herein, the apparatus of this invention may comprise the following.

DISCLOSURE OF INVENTION

Against the described background, an apparatus for steadily holding a container is provided in accordance with the present invention which allows the user to steadily hold the container with less stress to the thumb, hand, and wrist and which eliminates the need to use the thumb to stabilize the container. The container is of the type having a bottom, a side, and a bale handle having ends extending from the side and a middle portion downwardly pivotable towards the side. In its broadest sense, the apparatus includes engaging means, releasably engagable with the bale handle of the container when the bale handle is downwardly pivoted toward the container's side, for stabilizing the container relative to a palm of the hand when the container is held with the fingers of the same hand against the bottom of the container; and means for securing the engaging means relative to the palm of the hand in a fixed position generally adjacent to the palm of the hand. Thus, when engaged with the bale handle, the engaging means interconnects the bale handle with the securing means to hold the container in a generally stable orientation relative to the palm without using the thumb. To distribute the weight of the container across the entire hand, the securing means includes a first surface, sized and configured for positioning adjacently to the palm of the hand, and a second surface, sized and configured for positioning adjacently to the back of the hand so that the hand may be slid between the first and second surface with the palm against the first surface and the back of the hand against the second surface.

In a preferred embodiment of the present invention, the second surface extends from said first surface, generally parallel thereto, and forms a hand compartment with the first surface for slidably receiving the hand, and the engaging means extends from the first surface. Preferably the first surface covers the entire palm between the base of the fingers and the wrist and includes a portion which covers the heel of the hand, and the engaging means is located on the first surface adjacently to the heel portion. Thus, stress to the thumb is minimized when the container is being held with the apparatus. The apparatus additionally includes a thumb sleeve and a plurality of finger sleeves extending from the hand compartment. When the hand is slid into the hand compartment, the thumb sleeve at least partially receives thumb of the hand, and each of the finger sleeves at least partially receives its respective finger of the hand. The hand compartment, thumb sleeve, and finger sleeves of the apparatus thus act like a glove in a preferred embodiment of the present invention.

The engaging means, preferably, includes mounting means for mounting the engaging means to the first surface, and hook means extending from the mounting means and having an arcuate portion of at least 90 degrees to releasably engage the bale handle of the container such that said arcuate portion remains attached to the bale handle during normal orientations of the hand while the container is held with one hand with the apparatus. The apparatus further includes wrist engaging means to also support the wrist when the container is held with the engaging means engaged to the bale handle and the fingers of the same hand against the bottom of the container. Additionally, a generally planar portion is provided extending laterally across the first surface and having padding means for padding a part of the first surface such that said padding means contacts the container bottom when the container is held with the fingers against the bottom of the container, thus reducing discomfort to the hand.

The invention also provides a method for the manufacture of an apparatus of the present invention. The method includes the steps of providing engaging means, releasably engagable with the bale handle of the container; providing means for securing the engaging means in a fixed position relative to and generally adjacent with the palm of the hand; and connecting the engaging means to the securing means, such that when said securing means is worn on the hand the engaging means is in fixed position generally adjacent to the palm of the hand and is capable of engaging the bale handle of the container, when the bale handle is downwardly pivoted toward the container's side, to stabilize the container relative to the palm of the hand when the container is held with the fingers of the same hand against the bottom of the container. The step of providing securing means includes providing a first surface and second surface to form a hand compartment for slidably receiving the hand between the first and second surface with the palm against the first surface and the back of the hand against the second surface. The first surface covers the entire palm between the base of the fingers and the wrist, and includes a portion covering the heel of the hand. The step of connecting the engaging means includes mounting the engaging means to the first surface in an area adjacent to the heel portion, to minimize stress to the thumb when the container is held with the apparatus. The method further includes providing wrist engaging means for engaging a wrist of the hand, and connecting the wrist engaging means to the securing means to help keep the engaging means in place and to support the wrist.

The invention also provides a method of steadily holding a container, such as a paint can, with one hand, with reduced stress to the thumb and hand. The method includes the steps of providing a container having a bale handle and providing an apparatus for steadily holding a container with one hand. The apparatus includes engaging means, releasably engagable with the bale handle of the container when the bale handle is downwardly pivoted toward the container's side, for stabilizing the container relative to a palm of the hand when the container is held with the fingers of the same hand against the bottom of the container. The apparatus further includes means for securing the engaging means about the palm of the hand in a fixed position generally adjacent to the palm of the hand. The method further includes the steps of pivoting the bale handle toward the container's side, and engaging the engaging means to the bale handle. The method further includes the step of supporting the container from the bottom by locating the fingers of the same hand against the bottom of the container. In a preferred embodiment of the present invention, the securing means is in the form of a hand compartment and the step of securing the base surface includes sliding the hand compartment over the hand with the palm of the hand adjacent to the first wall and a back of the hand adjacent to the second wall. In a preferred embodiment of the present invention, the apparatus further includes padding means for padding a part of the first surface, and the step of supporting the container further includes positioning the hand such that the padding means contacts the container bottom.

Additional objects, advantages and novel features of the invention shall be set forth in part in the description that follows, and in part will become apparent to those skilled in the art upon examination of the following or may be learned by the practice of the invention.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

FIGS. 1–9 disclose an apparatus 10 of the present invention for steadily holding a container in one hand so that the stress to the hand of the person holding the container is reduced, particularly in the thumb region of the hand. The thumb region is defined as the thumb and the heel of the hand, at the base of the thumb which provides rotation of the thumb.

Figure 1:
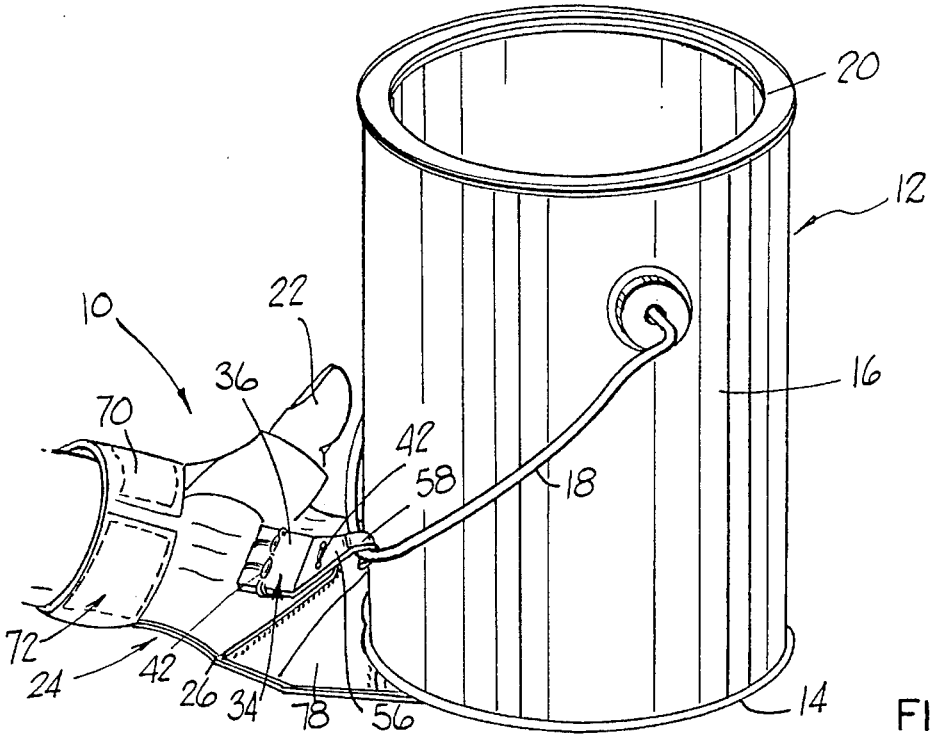
FIG. 1 is a perspective view illustrating a user's hand holding a container with an apparatus of the present invention.

The apparatus 10 is for use with any type of hand held container having an engaging surface generally alongside of the container. FIG. 1 shows the container 12 as a paint container having a bottom 14 and a side 16. The engaging surface of the container shown in FIG. 1 is a conventional bale handle 18, although modifications to conventional containers could provide other engaging surfaces for the purposes of this invention. The bale handle 18 has ends extending from the side 16 and a middle portion downwardly pivotable against the side 16, or upwardly pivotable above the top rim 20 for conventionally carrying the container 12 from one place to another. Thus, the container 12 is supported by the bale handle 18 below a substantial portion of the bale handle 18. As will be appreciated, in this position, the middle portion of the bale handle 18 subtends the opening (not numbered) of the container 12 enclosed by its top rim 20 and acts as a hinderance in dipping a paintbrush into the container 12. Therefore, during periods of repeated paintbrush dipping to access the paint, a painter will support the container 12 by placing her fingers, as shown in FIG. 1, against the bottom 14 of the container. To stabilize the container 12, the painter will swing the handle 18 downwardly against the side 16 of the container 12, or thereby, and typically hook a thumb 22 about the bale handle 18 to steadily hold the container 12. In this position, the painter's hand quickly gets tired, particularly around the thumb area, wrist area, fingers, heel of the hand, and back of the hand.

Figure 2:
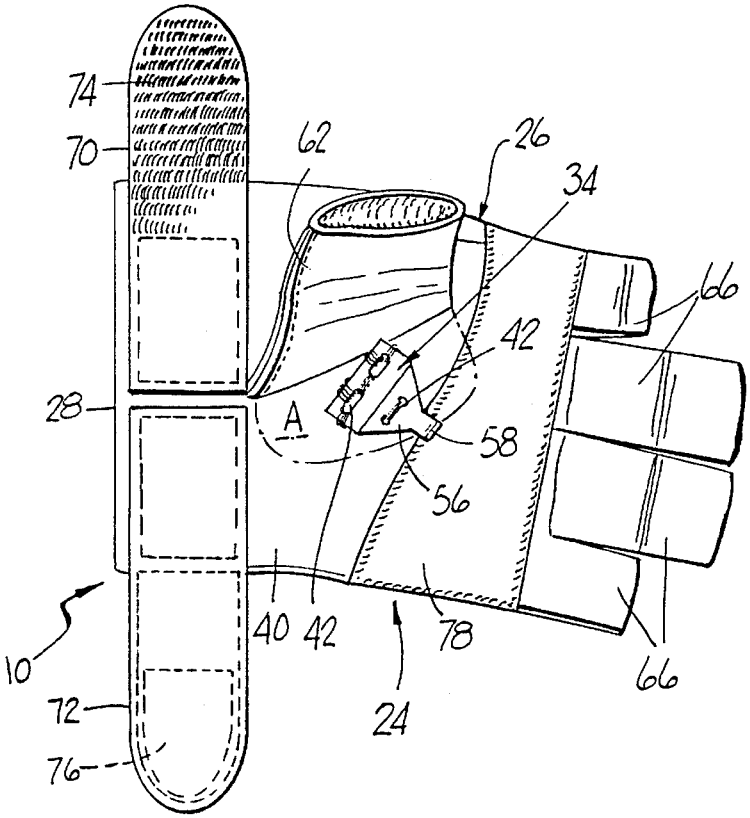
FIG. 2 is a plan view illustrating an engaging means and means for securing the engaging means of an apparatus of the present invention in the form of a glove.
Figure 3:
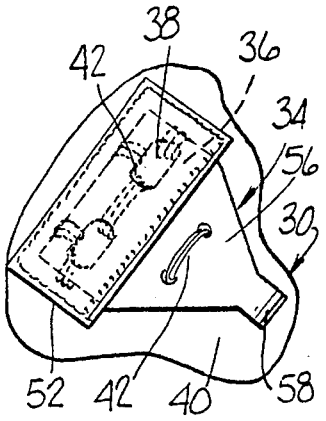
FIG. 3 is an enlarged fragmentary plan view illustrating the engaging means of the present invention mounted to a first surface of the securing means.
Figure 9:
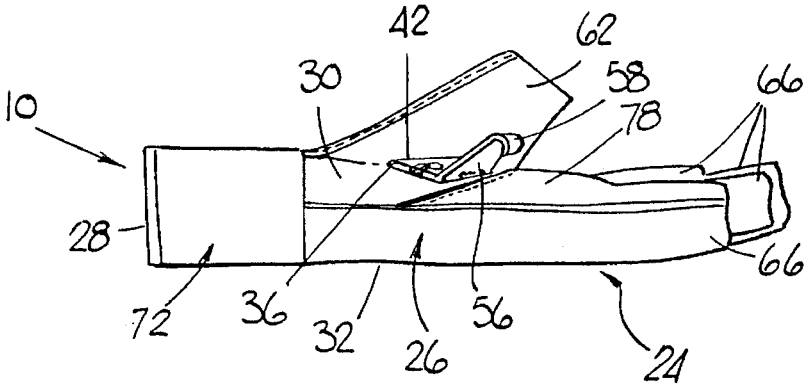
FIG. 9 is a side elevation view of an apparatus of the present invention in the form of the glove showing the orientation of the engaging means.

To alleviate these fatigues, as shown in FIGS. 1, 2 and 9, the apparatus 10 is worn about the users hand. In the preferred embodiment of the present invention, the apparatus 10 is worn as a glove, which acts as a securing means 24, as will be explained herein. The glove includes a hand compartment 26 having a hand opening 28 which is sized to receive a hand. The hand opening 28 is defined by, and the hand compartment 26 formed by, a first wall, or first surface, 30 adjacent to the palm of the hand when the apparatus 10 is worn, and a second wall, or second surface, 32 extending from the first surface 30 generally parallel to it, adjacent to the back of the hand when the hand is slid into the hand compartment 26. Any suitable material may be used to form the glove, or the hand compartment, but is preferrably a thick material for additional support such as suede.

In accordance with an important aspect of the present invention, an engaging piece, or engaging means, 34 is shown in FIGS. 1–9. It is important to the practice of this invention that the engaging piece 34 be secured in a fixed position relative to the palm (not numbered) of the hand generally adjacent to the palm so that it is, releasably engagable with the bale handle 18 when the bale handle 18 is downwardly pivoted toward the side 16, to stabilize the container 12 relative to the palm of the hand when the container 12 is held with the fingers of the same hand against the bottom 14 of the container. This positioning is provided by the securing means 24.

Figure 4:
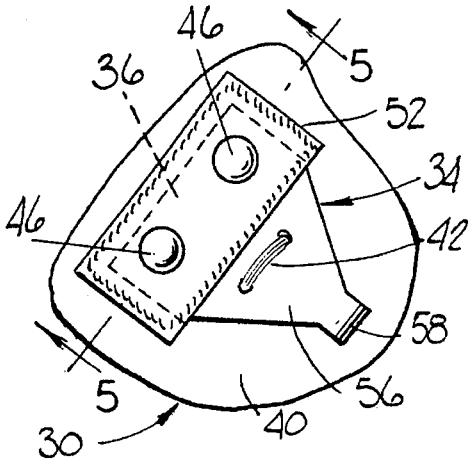
FIG. 4 is an enlarged fragmentary plan view illustrating the engaging means of the present invention with alternate mounting means.
Figure 5:
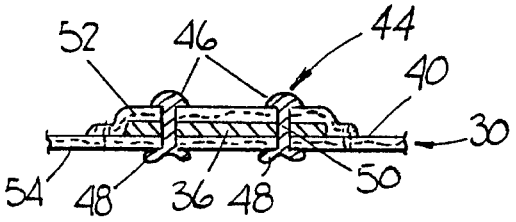
FIG. 5 is an enlarged vertical section view, taken along the line 5—5 in FIG. 4, showing the base of the engaging means mounted to the first surface of the securing means.
Figure 6:
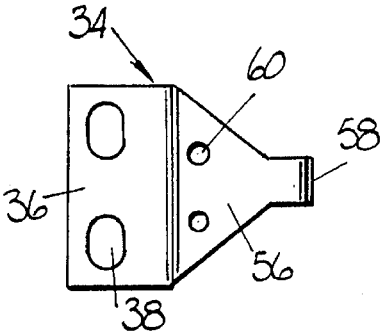
FIG. 6 is an enlarged top view of the engaging means.
Figure 7:
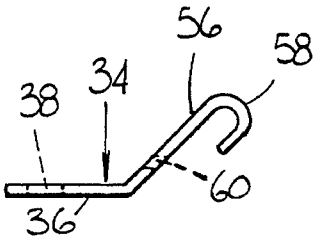
FIG. 7 is an enlarged side view of the engaging means.
Figure 8:
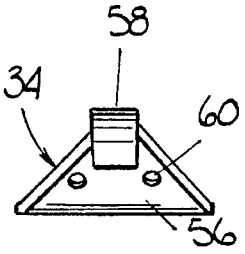
FIG. 8 is an enlarged front view of the engaging means.

The engaging piece 34, as best seen in FIGS. 6–8, and which may be made from lightweight metal or hardened plastic, includes a base portion, or mounting means 36, having a pair of apertures 38 therethrough. The base portion 36 is mounted to the outside 40 of the first surface 30. As shown in FIG. 2, the base portion 36 may be mounted to the outside 40 by a flexible string material 42, such as a strong nylon thread so that it is difficult to manually separate the base portion 36 from the outer surface 40. It is important to note that the flexible string material 42 should only pierce the first surface 30 and not the second surface 32 so that the interior of the hand compartment 26 is freely openable for a hand to be slid therein. Alternatively, as shown in FIGS. 4 & 5, a rivet 44 may be used to mount base portion 36 to the outside 40, instead of flexible string material 42. As illustrated in FIG. 5, the rivet 44 has a first retaining end 46 and a second retaining end 48 interconnected by a rigid shaft member 50. The first retaining end is used to secure a cover 52, over the base portion 36 so that the base portion is not visible. As shown in FIG. 4, the cover 52 is also stitched to the outside 40 of the first surface 30. It will be noted that the cover is an optional feature which adds aesthetic quality to the apparatus 10 but is not necessary to its functioning; and furthermore, that many other ways of improving the aesthetic qualities of the present invention may be utilized. The rigid shaft member 50 extends through the aperture 38 in base portion 36. The second retaining end 48 secures the base portion 36 against the outside 40 by rigidly abutting the inside 54 of the first surface 30. It will further be appreciated that the mounting means 36 provided by the base portion 36, could be provided in many other ways.

As seen in FIGS. 6–8, the engaging piece 34 also has a hooking means comprised of a rigid extension portion 56 integrally extending from the base portion 36 at an obtuse included angle with the base portion and having a hook, or arcuate portion, 58 at its distal end. The arcuate portion 58 is at least 90 degrees, allowing the releasable engagement of the engaging piece 34 to the bale handle 18. Thus, the hook 58 has a sufficient curvature to releasably engage the bale handle 18 such that the hook remains attached to the bale handle when the container is tipped during normal orientations of the hand. (ie., less that 45 degrees from the horizontal). It will be appreciated that other hooking means 58, such as a loop with one end fixedly attached to the outside 40 and the other end variably releasably attached to the outside 40 could also be used. However, the inventor has found the hooking means shown in FIGS. 6–9, to be optimal. It will be noted that the extension portion, as shown in FIGS. 3–8, also includes a pair of apertures 60 attached to the outside 40 by flexible string material 42. Thus, when the engaging piece 34 is engaged to the bale handle 18, the flexible string material maintains the extension portion 56 in a stable position with respect to the first surface 30, so that the entire engagement piece 34 remains in a stable position when engaged to the bale handle 18.

The securing means 24 further includes a thumb sleeve 62. The thumb sleeve 62 has a base 64 and extends from the hand compartment 26 at the base 64. When a hand is placed in the hand compartment 26, the thumb is partially received by the thumb sleeve 62. Alternatively, instead of a cut-off thumb sleeve as shown in FIGS. 1,2 and 9, a full thumb sleeve could be used which would receive the entire thumb. A plurality of finger sleeves 66 also extend from the hand compartment 26 and receive each of the fingers of a hand placed into the hand compartment 26. The finger sleeves 66 may also be as those shown which receive only a portion of each finger or full finger sleeves which receive the entire length of each finger and completely cover the finger. It is preferable in the use of this device that only partial thumb and partial finger sleeves are used to maintain manual dexterity. The thumb 62 and finger sleeves 66 help fix the location of the engaging means 34 relative to the palm of the hand by partially preventing the hand compartment from slipping on the hand when the apparatus is worn and used to support the container.

Turning to the orientation of the engaging means 34 with respect to the securing means 24, the extension portion 56, as shown in FIGS. 1, 2 and 9 extends away from the base 64 of the thumb sleeve 62 generally towards the center region (not numbered) of the outside 40, but rotated slightly towards the thumb. This optimizes the engagement of the engaging means and the bale. The extension portion 56 only need be a sufficient length to allow the hook 58 to engage the bale handle 18 of the container 12 when a user has her hand in the glove compartment 26 and has her fingers against the bottom 14 of the container 12 so that the thumb 22 is no longer used in any manner to stabilize the container 12. Though this length can vary slightly between users of differing hand sizes, a universal length may be used to cover most users.

The obtuse included angle between the base portion 36 and extension portion 56 may vary but should be between 120 and 150 degrees. If the angle is on the greater side of that range, the painter must cup her hand slightly more with her fingers underneath the bottom 14 of the container 12. If the angle is on the lesser side of that range, the painter may hold her hand somewhat flatter with her fingers underneath the bottom 14 of the container 12.

The first surface 30 covers the entire palm between the base of the fingers and the wrist, and the second surface 32 covers the entire back of the hand between the base of the fingers and the wrist. Thus, all stresses previously experienced by the thumb 22 are now absorbed by the apparatus 10 itself, or distributed over a substantial portion of the hand, allowing the painter to be able to readily hold the paint container 12 for long durations with minimal discomfort and harm to the hand. It will be appreciated that the first 30 and second 32 surfaces need not cover the entire palm and back of the hand, respectively, but may be in the form of cross straps, or another form, which secure the engaging means 34 in a fixed position generally adjacent to the palm of the hand. It will further be appreciated that the hand compartment 26 formed by such cross straps will allow a hand to be slid thereinto. As shown in FIG. 2, the thumb sleeve 62 covers the heel of the hand. The engaging means 34 is located on a portion A of the first surface which is adjacent to the heel covering portion to thus minimize stress to the thumb and to increase the convenience of the apparatus.

To increase the comfort and universality of apparatus 10, wrist engaging means is provided for engaging the wrist to support the user's wrist. As best shown in FIG. 2, the wrist engaging means comprises a first strap 70 and an opposed strap 72 extending from the first surface 40. The first strap 70 bears a swath 74 of hook fasteners. The second strap 72 bears a swath 76 of loop fasteners thereon and, as well known in the art, the two swaths overlap and engage in selectively adjustable positions to adjust the size of the hand opening and to tighten the hand compartment about the painter's hand. In this manner the glove 24 may be reasonably and comfortably adjusted about the wrist of the painter and thereby support it. Furthermore, to decrease or eliminate any pain to the palm of the painters hand caused by supporting the edge (not numbered) of the bottom 14 of the container 12 against the palm of the hand while supporting the container, a generally planar portion 78 is attached laterally across the outer surface 40 of the first wall 30. The planar portion 78 includes padding, or padding means, and a cover made of the same material as the outer surface 40 to cover the padding. The planar portion is positioned to generally contact the edge of the container bottom 14 when the painter is supporting the container 12 with her fingers underneath the bottom 14 to harmlessly absorb the weight of the container 12 into the padding and thereby reduce discomfort to the painters hand.

In use, a painter slides her hand into the hand compartment 26 with her palm against the first surface 30 and the back of her hand against the second surface 32, and tightens the hand compartment over her hand with the provided wrist straps 70, 72. With her thumb extending out of the thumb sleeve, and fingers extending out of the finger sleeves, the painter takes the engaging piece 34 and engages the hook 58 of the engaging piece to the bale handle 18 of the container 12. With the bale handle 18 so engaged, the painter then takes her fingers and places them against the bottom 14 of the container 12. In this position the painter can support the container 12 with her hand utilizing the apparatus 10 to stabilize the paint container and prevent it from tipping.

As will be appreciated by the foregoing, apparatus 10 is provided which may be used by painters and others holding a container 12 having a bale handle 18 to steadily hold the container 12 with less stress to the thumb and greater comfort to the hand to minimize injury and discomfort thereto which may occur over long periods of so holding the container. It will be appreciated that with the provided apparatus 10, a painter may hold the paint container 12 in a position convenient for ready, repeated dipping of a paintbrush into the container for long durations and with greater ease and comfort.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. An apparatus for steadily holding a container with one hand of the type having an open top, a bottom, a side, and a bale handle having ends extending from the side and a middle portion downwardly pivotable towards the side, to stabilize the container relative to the palm of the hand with the container held with the fingers of the same hand against the bottom of the container, said apparatus comprising:

engaging means, releasable engagable with the bale handle of the container when the bale handle is downwardly pivoted toward the container's side to position the bale handle in a fixed position relative to the palm of the hand with the container held with the fingers of the same hand against the bottom of the container; and means for securing said engaging means in a fixed position relative to the palm of the hand generally adjacent to the palm of the hand, said engaging means including a base portion attached to said securing means adjacent the heel of the hand, and a rigid extension portion extending from said base portion towards the center line of hand at an obtuse included angle with said base portion, said extension portion further having an arcuate distal end arcing towards the palm of the hand to apply a downward force on the bale handle.

2. An apparatus, as claimed in claim 1, wherein:

said securing means includes a first surface, sized and configured for positioning adjacently to the palm of the hand, and a second surface, sized and configured for positioning adjacently to the back of the hand so that the hand may be slid between said first and second surface with the palm against the first surface and the back of the hand against the second surface;

said base portion defines at least one aperture permitting first attaching means therethrough for attaching said base portion to said first surface; and said extension portion defines at least one aperture permitting second attaching means therethrough for attaching said extension portion to said first surface.

3. An apparatus, as claimed in claim 1, wherein:

said extension portion extends from said base portion at an included angle therewith of between 120 degrees and 150 degrees.

4. An apparatus, as claimed in claim 2, wherein:

said first attachment means comprises flexible string material.

5. An apparatus, as claimed in claim 2, wherein:

said second attachment means comprises flexible string material.

6. An apparatus, as claimed in claim 2, wherein:

said second surface extends from said first surface, generally parallel thereto, to form a hand compartment with said first surface for slidably receiving the hand; and further comprising a thumb sleeve extending from said hand compartment for at least partially receiving a thumb of a hand when the hand is received in the hand compartment; and a plurality of finger sleeves extending from said hand compartment for at least partially receiving the respective fingers of a hand when the hand is received in the hand compartment.

7. The apparatus of claim 2, wherein:

said arcuate portion arcs at least 90 degrees to releasable engage the bale handle of the container.

8. An apparatus, as claimed in claim 1, wherein:

said securing means includes wrist engaging means for engaging a wrist of the hand to also support the wrist when the container is held with the engaging means engaged to the bale handle and the fingers of the same hand against the bottom of the container.

9. The apparatus of claim 8, wherein said wrist engaging means includes:

a first strap extending from said securing means and bearing a swath of hook fasteners and a second strap extending from said securing means and bearing a swath of loop fasteners, such that said first and said second swath overlap and engage in selectively adjustable positions to tighten said wrist engaging means about the wrist of the hand.

10. The apparatus of claim 2, further comprising:

a generally planar portion attached laterally across said first surface and having padding means for padding a part of said first surface such that said padding means contacts the container bottom when the container is held with the fingers against the bottom of the container.

11. A method of steadily holding a container with one hand, the container having an open top, a bottom, a side, and a bale handle having ends extending from the side and a middle portion downwardly pivotable towards the side, said method comprising the steps of:

providing an apparatus comprising engaging means, releasable engagable with the bale handle of the container when the bale handle is downwardly pivoted toward the container's side to position the bale handle in a fixed position relative to the palm of the hand with the container held with the fingers of the same hand against the bottom of the container; and means for securing the engaging means in a fixed position relative to the palm of the hand generally adjacent to the palm of the hand, the engaging means including a base portion attached to the securing means adjacent the heel of the hand, and a rigid extension portion extending from the base portion towards the center line of hand and having an obtuse included angle with the base portion, said extension portion further having an arcuate distal end arcing towards the palm of the hand to apply a downward force on the bale handle;

wearing the securing means about the hand;

pivoting the bale handle toward the container's side;

engaging the engaging means to the bale handle; and supporting the container from the bottom by locating the fingers of the same hand against the bottom of the container.

12. A method, as claimed in claim 11, wherein:

the securing means includes a first surface and a second surface, extending from the first surface, generally parallel thereto, to form a hand compartment with the first wall for slidably receiving the hand; and the step of securing the base surface includes sliding the hand compartment over the hand with the palm of the hand adjacent to the first wall and a back of the hand adjacent to the second wall.

13. A method, as claimed in claim 11, wherein:

the arcuate portion arcs at least 90 degrees to releasable engage the bale handle of the container; and the step of engaging the engaging means to the bale handle includes hooking the arcuate portion about the bale handle from above the bale handle.

14. A method, as claimed in claim 11, wherein the apparatus further includes wrist retaining means, the method further including the step of:

closing the wrist retaining means about the wrist of the hand to further support the wrist of the hand while steadily holding the container with the apparatus.

15. A method, as claimed in claim 11, wherein the apparatus further includes padding means for padding a part of the first surface, and the step of supporting the container further includes:

positioning the hand such that the padding means contacts the container bottom.

* * * * *